US007040202B2

(12) United States Patent
Hsien

(10) Patent No.: US 7,040,202 B2
(45) Date of Patent: May 9, 2006

(54) SLIDE STOP DEVICE OF A HEXAGONAL SPANNER

(76) Inventor: Chih-Ching Hsien, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/858,431

(22) Filed: Jun. 2, 2004

(65) Prior Publication Data

US 2005/0268756 A1 Dec. 8, 2005

(51) Int. Cl.
*B25B 23/08* (2006.01)

(52) U.S. Cl. ..... 81/453; 81/443; 81/445
(58) Field of Classification Search ..... 81/442–448, 81/452–453
See application file for complete search history.

(56) References Cited

U.S. PATENT DOCUMENTS

| | | | | |
|---|---|---|---|---|
| 2,404,427 | A * | 7/1946 | Bloomfield | 81/443 |
| 2,775,913 | A * | 1/1957 | Deliso | 81/448 |
| 3,181,396 | A * | 5/1965 | Nance | 81/445 |
| 5,025,688 | A * | 6/1991 | Davis | 81/448 |
| 6,286,401 | B1 * | 9/2001 | Hajianpour | 81/453 |

* cited by examiner

*Primary Examiner*—Debra S Meislin

(57) ABSTRACT

A slide stop device of a hexagonal spanner comprises a spanner body; one end of the spanner body having a driving portion. The driving portion has at least one axial slots. Each slot is extended from a center of one end surface of the driving portion to an edge of the driving portion. An axial screw hole is formed in the center of driving portion; an outer end of the screw hole being a tapered shape. In use, a screwing resisting element is inserted into the screw hole. When the screwing resisting element is not tightly adhered to an wall of the screw hole, the screwing resisting element can expand the driving portion outwards to prevent the screwing resisting element from sliding.

2 Claims, 7 Drawing Sheets

SLIDE STOP DEVICE OF A HEXAGONAL SPANNER

FIELD OF THE INVENTION

The present invention relates to spanners for driving hexagonal screws, and particular to a slide stop device of a hexagonal spanner.

BACKGROUND OF THE INVENTION

In general, if a screw is used for a longer time, the screw will round so that it is difficult to drive the screw by a spanner. Thereby, it is often that the screw must be destroyed for taking the screw out. This will destroy the work piece.

Thereby, to improve the defect in the prior art, there are some ways are developed for resolving the prior art problem.

However, all these improvements are aimed to improve outer hexagonal screws (that is, a screw has a hexagonal driving portion at an outer side of the screw) instead of improving inner hexagonal screws (that is, a screw has a hexagonal driving portion at an inner side of the screw).

This is because, referring to FIG. 9, the conventional spanner for driving an inner hexagonal screw has a solid structure which does not deform. Each spanner is designed for screws with predetermined sizes. As the inner hexagonal screw has rounded edges so that as the hexagonal screw is driven, it will slide with respect to the spanner so that it can not be effectively driven.

However, for the outer hexagonal screws, the conventional spanner has expandable clamping portions at two ends thereof so that as the edges of the hexagonal portion of an outer hexagonal screw are rounded, the clamping portions can deform to match the round edges of the outer hexagonal screws, but no this mechanism is design for the conventioanl spanner for driving the inner hexagonal screws.

SUMMARY OF THE INVENTION

Accordingly, the primary object of the present invention is to provide a slide stop device of a hexagonal spanner which comprises a spanner body; one end of the spanner body having a driving portion; the driving portion having at least one axial slot; each slot extending from a center of one end surface of the driving portion to an edge of the driving portion; an axial screw hole being formed in the center of driving portion; a shape of an outer end of the screw hole being a tapered shape.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
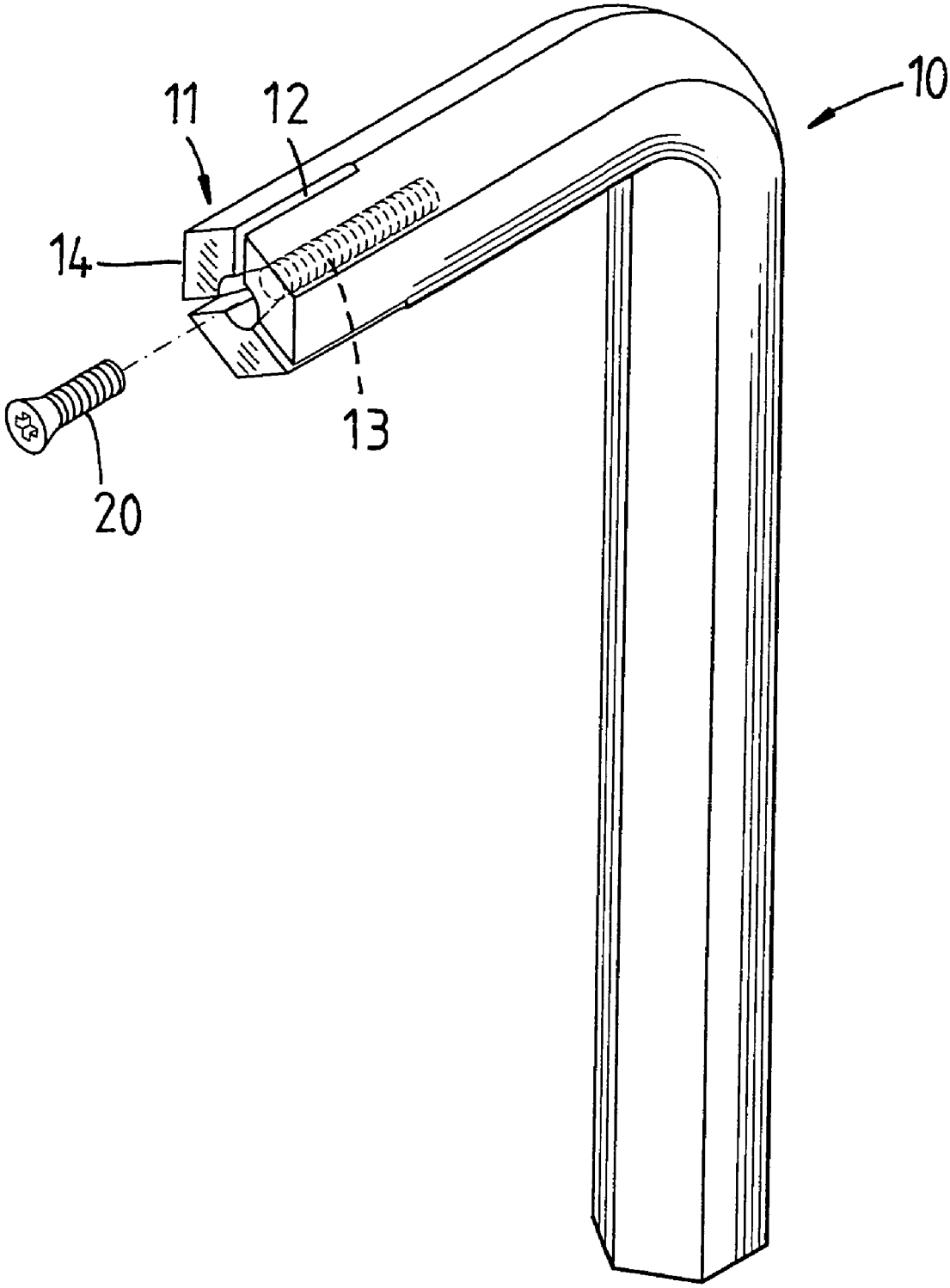
FIG. 1 is an exploded perspective view of a first embodiment of the slide stop device of a hexagonal spanner of the present invention.

With reference to FIG. 1, the slide stop device of a hexagonal spanner of the present invention is illustrated. The slide stop device of a hexagonal spanner includes the following elements.

A spanner body 10 is enclosed. One end of the spanner body 10 has a driving portion 11. The driving portion 11 has three axial slots 12. Each slot extends from a center of one end surface of the driving portion 11 to one of the apexes of a hexagonal cross section of the driving portion 11. An axial screw hole 13 is formed in the center of driving portion 11. An outer end of the screw hole 12 has a tapered shape.

A screwing resisting element 20 has one tapered head for matching the shape of the screw hole 13. The screwing resisting element 20 serves for enforcing the driving portion 11 to deform.

In the present invention, the screwing resisting element 20 and the screw hole 13 can be threaded for engagement to one another.

In the hexagonal spanner of the present invention, a screw hole is formed. By this space, the hexagonal spanner can deform from this portion so as to screw a loosely engaged inner hexagonal screw.

Figure 2:
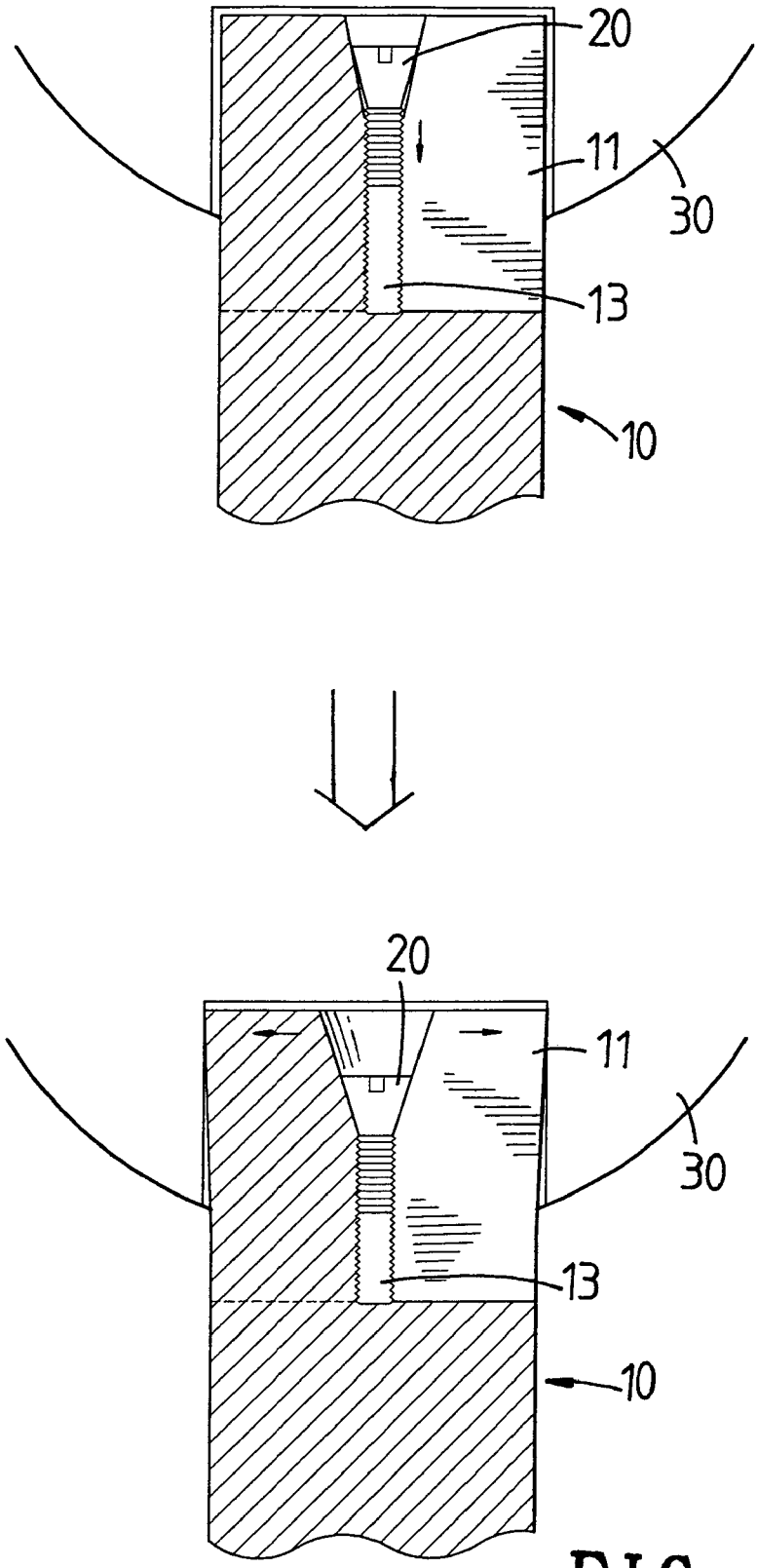
FIG. 2 shows the operation of the slide stop device of a hexagonal spanner of the present invention.

In use, referring to FIG. 2, when the spanner body 10 is placed in an inner side of an inner hexagonal screw 30, if initially, the hexagonal screw 30 do not fully resists against the spanner body 10, the driving portion 11 can be expanded by further screwing the screw resisting element 20 in the screw hole 13. Thereby, the spanner body 10 tightly contacts an inner wall of the inner hexagonal screw 30.

Figure 3:
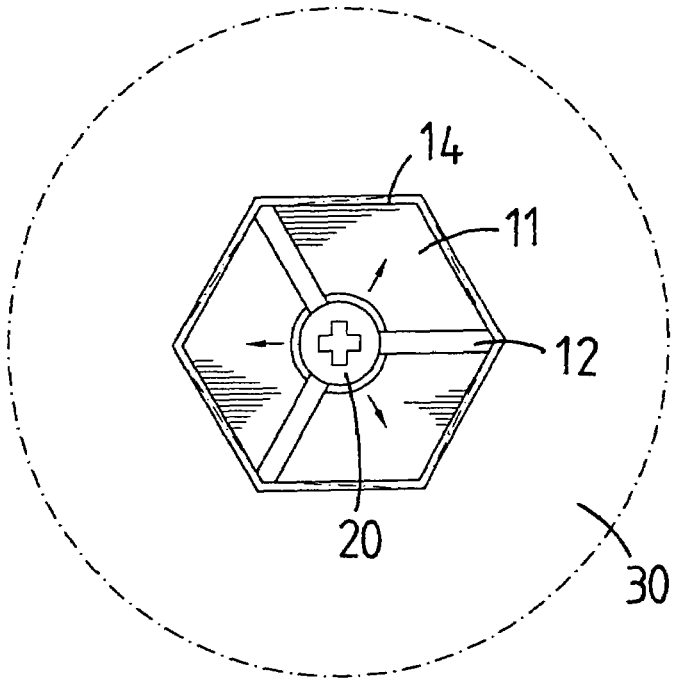
FIG. 3 shows the application of the slide stop device of a hexagonal spanner of the present invention.

In general use of the hexagonal spanner, as shown in FIG. 3 which is a schematic view about the driving portion 11, wherein dashed lines represent when the screwing resisting element 20 screws into the screw hole 13 of the driving portion 11, the driving portion 11 can expand outwards to resist against the inner wall of the hexagonal screw 30 so as to rotate the screw.

Figure 4:
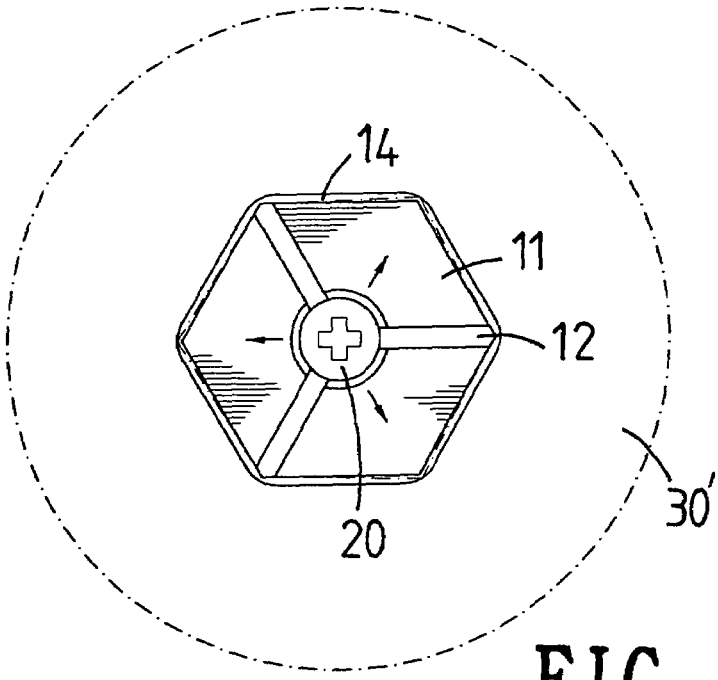
FIG. 4 shows a further application of the slide stop device of a hexagonal spanner of the present invention.

Referring to FIG. 4, it is illustrated that the apexes of the inner hexagonal screw 30' are rounded. When the hexagonal screw 30' is loosely engaged to an outer wall of the driving portion 11, the screwing resisting clement 20 screws into the screw hole 13 of the driving portion 11, referring to the dashed lines indicated, the driving portion 11 will expand outwards so that the outer wall of the driving portion 11 will resist against the inner wall of the hexagonal screw 30'.

Figure 5:
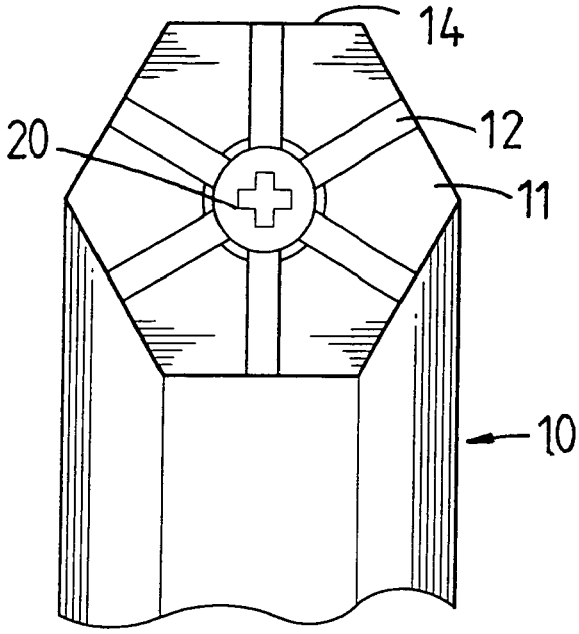
FIG. 5 shows the second embodiment of the slide stop device of a hexagonal spanner of the present invention.

Referring to FIG. 5, the second embodiment of the present invention is illustrated. In FIG. 5, there are six slots 12. Each slot is distributed from the center of the driving portion 11 to one apex of the hexagonal cross section of the driving portion.

Figure 6:
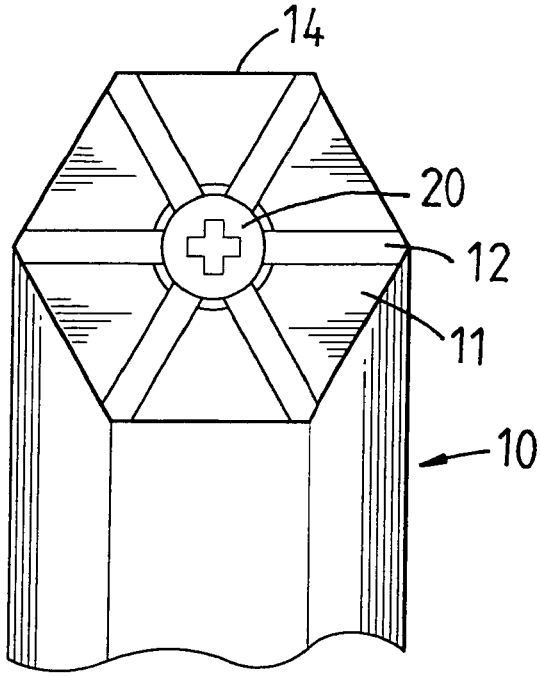
FIG. 6 shows the third embodiment of slide stop device of a hexagonal spanner of the present invention.

With reference to FIG. 6, the third embodiment of the present invention is illustrated. In FIG. 6, there are six slots 12. Each slot is formed from the center of the driving portion 11 to a respective edge of the hexagonal driving portion 11 between two apexes.

Figure 7:
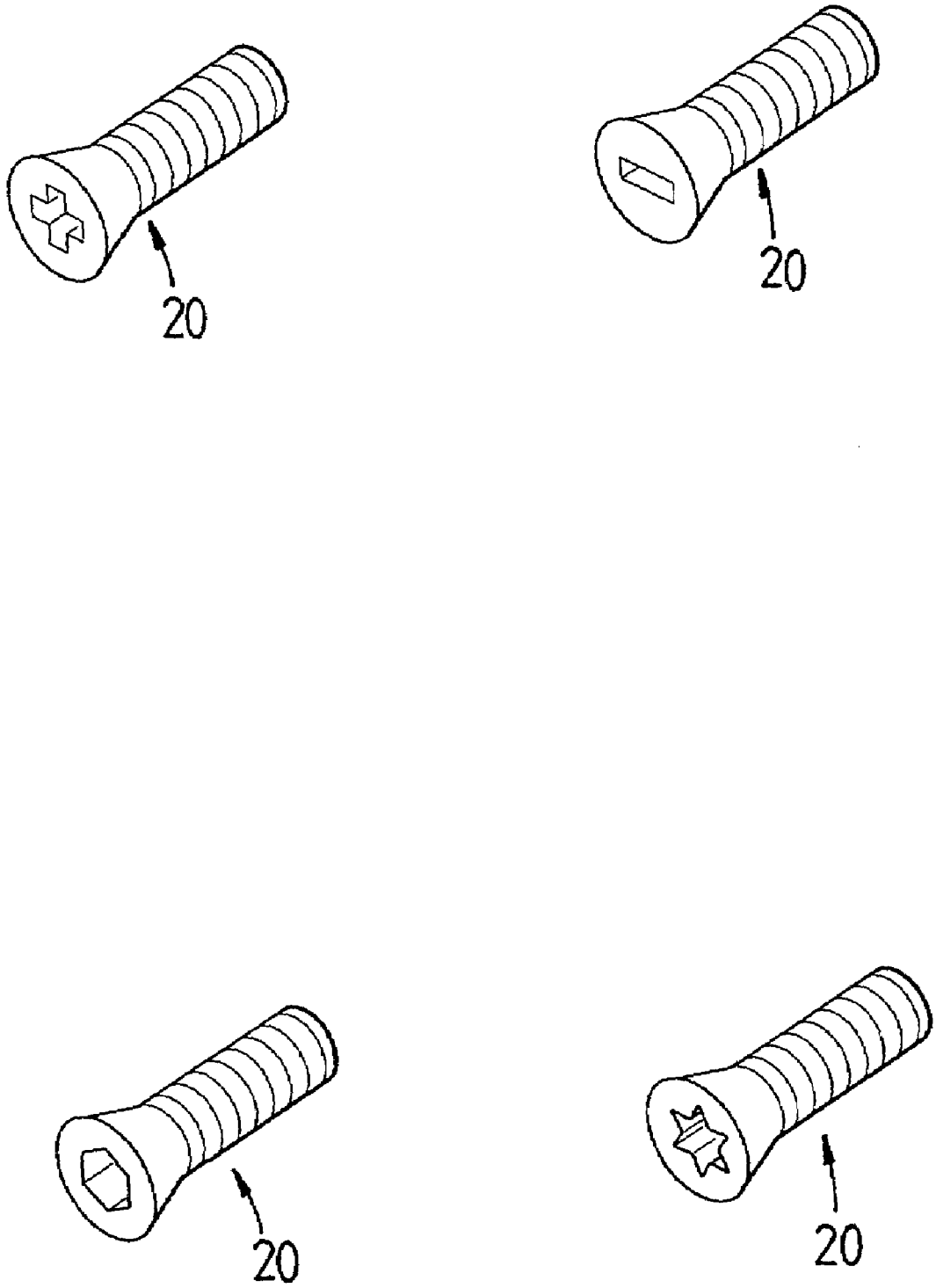
FIG. 7 shows the fourth embodiment of the slide stop device of a hexagonal spanner of the present invention.

Referring to FIG. 7, a fourth embodiment of the present invention is illustrated. It is illustrated in the screwing resisting element 20 may have a hole having a cruciform shape, a straight slot shape, a hexagonal shape, or a star shape.

Figure 8:
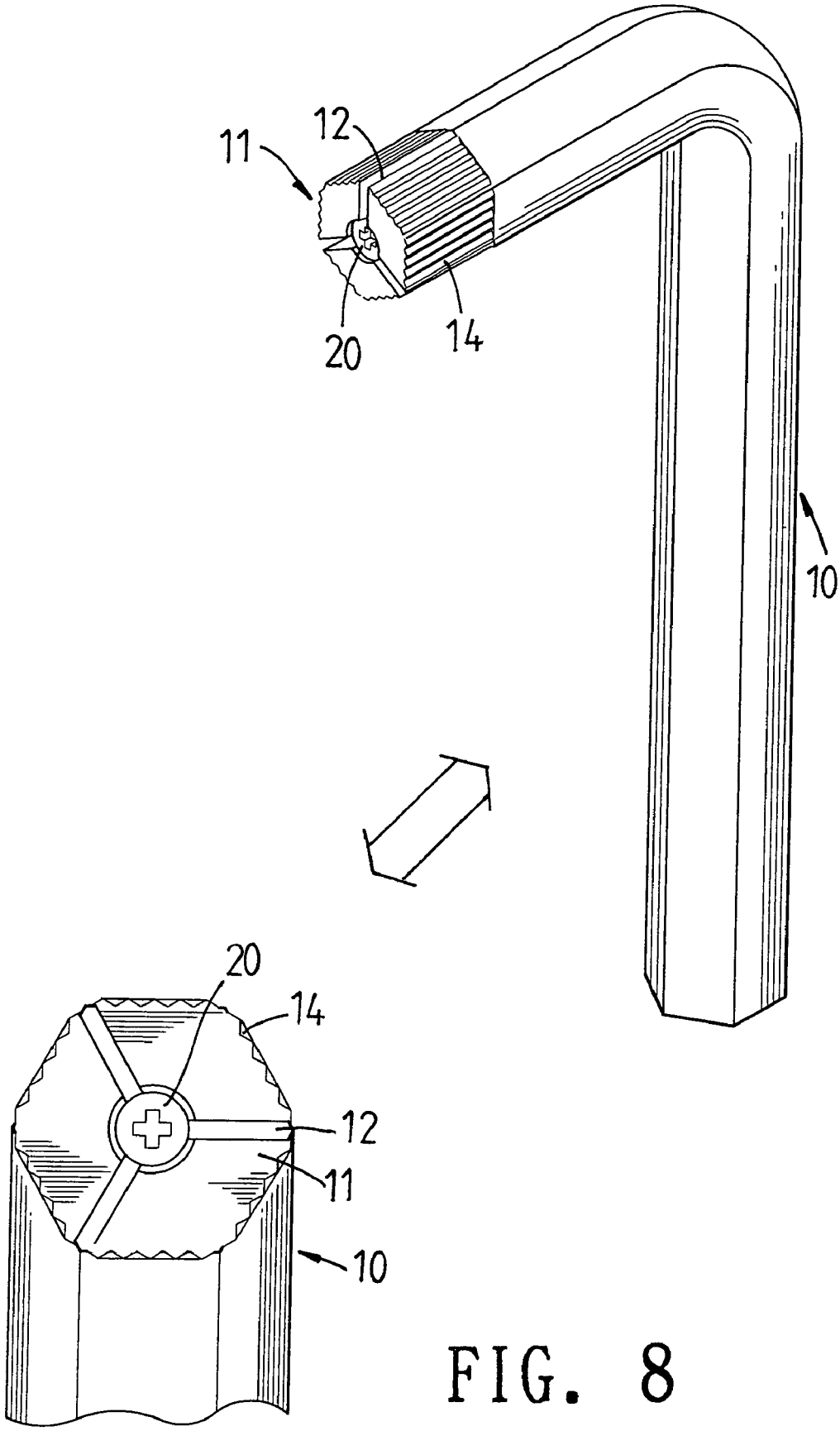
FIG. 8 shows the fifth embodiment of the slide stop device of a hexagonal spanner of the present invention.
Figure 9:
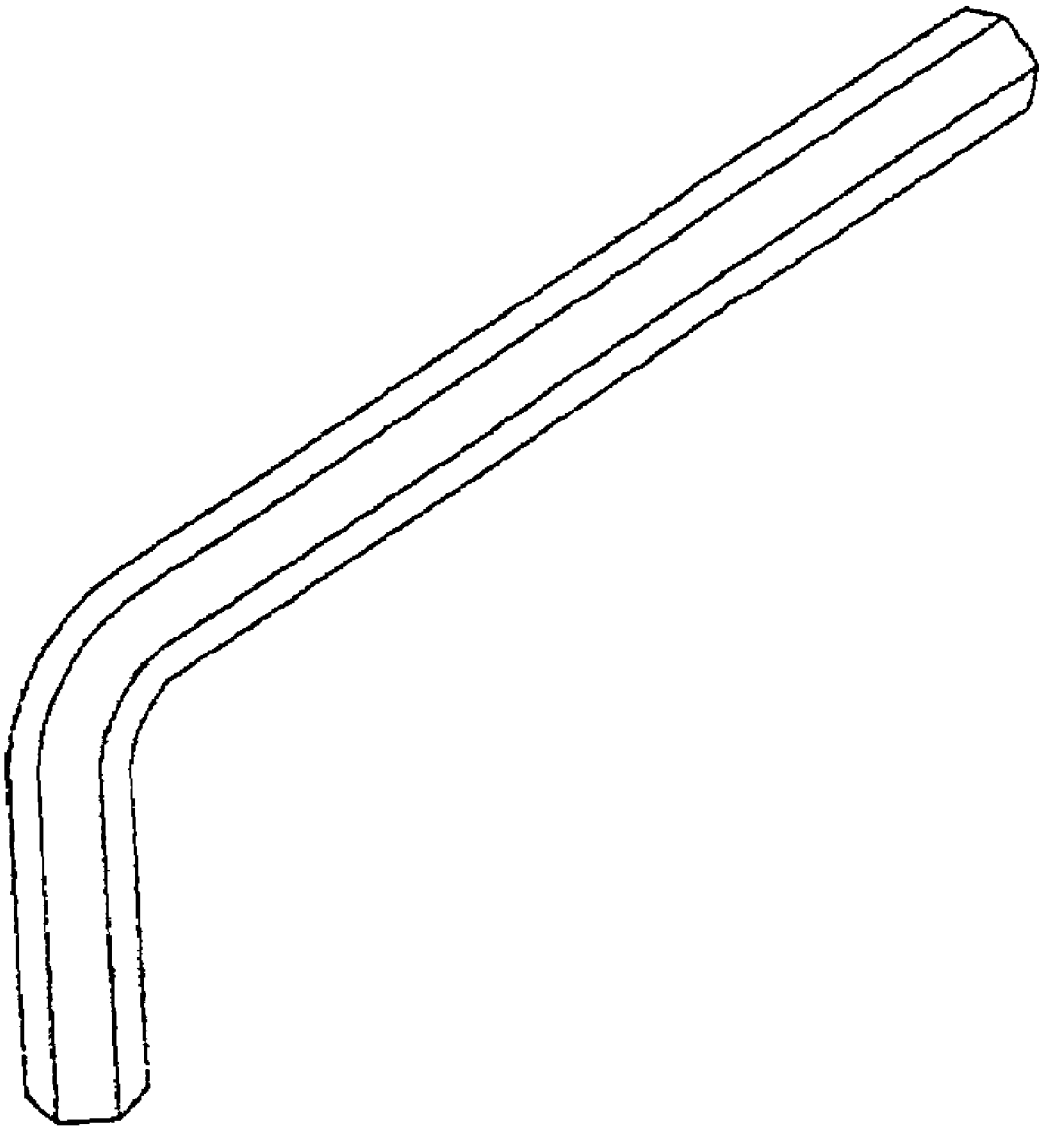
FIG. 9 PRIOR ART
FIG. 9 shows a schematic view of a prior art hexagonal spanner.

With reference to FIG. 8, the fifth embodiment of the present invention is illustrated. The outer wall of the driving portion 11 are teethed, or waved (not shown), or textured (not shown), or formed with regular or irregular shapes (not shown) so as to increase the friction force in rotation.

The present invention is thus described, it will he obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A slide stop device of a hexagonal spanner for preventing a rounded edged inner hexagonal screw to slide as the hexagonal spanner drives the inner hexagonal screw; the slide stop device comprising:

a spanner body; one end of the spanner body having a driving portion; the driving portion having at least one axial slot; each slot being extended from a center of one end surface of the driving portion to an edge of the driving portion;

an axial screw hole being formed in a center of driving portion; an end of the screw hole being a tapered shape;

a screwing resisting element having one tapered head for matching the shape of the screw hole; the screwing resisting element serving for enforcing the driving portion to deform and expand outwards as the screwing resisting element is inserted into the axial screw hole of the driving portion; and wherein the screwing resisting element and the screw hole are threaded for engaging to one another.

2. The slide stop device of a hexagonal spanner as claimed in claim 1, wherein the screwing resisting element has a hole having a shape selected from one of cruciform shapes, straight slot shapes, hexagonal shapes, and star shapes.

* * * * *